US008333391B2

(12) United States Patent
Meijer

(10) Patent No.: US 8,333,391 B2
(45) Date of Patent: Dec. 18, 2012

(54) FRAME FOR A CLAP SKATE, AND CLAP SKATE WITH SUCH A FRAME

(75) Inventor: Jan-Willem Meijer, Mijdrecht (NL)

(73) Assignee: Widee B.V., Lutten (NL)

( * ) Notice: Subject to any disclaimer, the term of this patent is extended or adjusted under 35 U.S.C. 154(b) by 268 days.

(21) Appl. No.: 12/669,326

(22) PCT Filed: Jul. 17, 2008

(86) PCT No.: PCT/NL2008/050493

§ 371 (c)(1),
(2), (4) Date: Jun. 29, 2010

(87) PCT Pub. No.: WO2009/011586

PCT Pub. Date: Jan. 22, 2009

(65) Prior Publication Data

US 2010/0264638 A1 Oct. 21, 2010

(30) Foreign Application Priority Data

Jul. 17, 2007 (NL) ..... 1034143

(51) Int. Cl.
*A63C 1/00* (2006.01)

(52) U.S. Cl. ..... 280/11.27; 280/11.12; 280/11.224

(58) Field of Classification Search ..... 280/11.14, 280/11.15, 11.224, 11.225, 11.27, 11.28, 280/11.12

See application file for complete search history.

(56) References Cited

U.S. PATENT DOCUMENTS

| | | | | |
|---|---|---|---|---|
| 6,079,717 | A | 6/2000 | Meester et al. | |
| 6,082,744 | A * | 7/2000 | Allinger et al. | 280/11.12 |
| 6,105,975 | A | 8/2000 | Shum | |
| 6,193,243 | B1 * | 2/2001 | Johannes Meester et al. | 280/11.221 |
| 6,736,412 | B1 * | 5/2004 | Krah | 280/11.224 |
| 6,883,811 | B2 * | 4/2005 | Tlucko | 280/11.224 |
| 6,971,652 | B2 * | 12/2005 | Bobbert et al. | 280/11.27 |
| 7,419,187 | B2 * | 9/2008 | Haugen et al. | 280/841 |
| 2003/0052463 | A1 | 3/2003 | Tlucko | |

FOREIGN PATENT DOCUMENTS

| | | | |
|---|---|---|---|
| NL | 1005080 | C2 | 7/1998 |
| NL | 1007231 | C2 | 4/1999 |
| NL | 1007303 | C1 | 4/1999 |
| NL | 1013271 | C2 | 4/2001 |
| NL | 1017598 | C2 | 9/2002 |
| NL | 1019089 | C2 | 4/2003 |
| RU | 2 029 895 | C1 | 2/1995 |
| WO | 0126755 | A1 | 4/2001 |

* cited by examiner

*Primary Examiner* — John Walters

(74) *Attorney, Agent, or Firm* — The Webb Law Firm

(57) ABSTRACT

A frame for a clap skate comprises: a lower frame part; an upper frame part with means for coupling to the sole and heel of a skate shoe; hinge which couples the two frame parts hingedly to each other and which are situated at a distance above the foremost zone of the lower frame part and define a first free degree of freedom of rotation, or a plane varying a maximum of about 30° therefrom of the runner; and resetting means for urging the upper frame part to a rest position determined by positioning means, in which rest position the frame parts have the smallest possible mutual distance. The hinge defines a second free degree of freedom of ±30° perpendicularly of the first free degree of freedom. The upper frame part performs an up and downward and lateral pivoting movement relative to the lower frame part.

26 Claims, 9 Drawing Sheets fig 12a
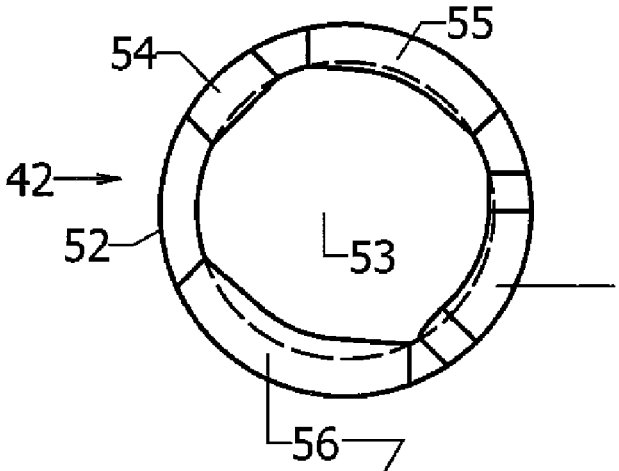
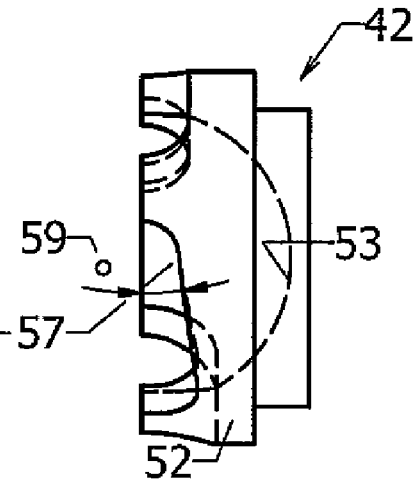
fig 12b
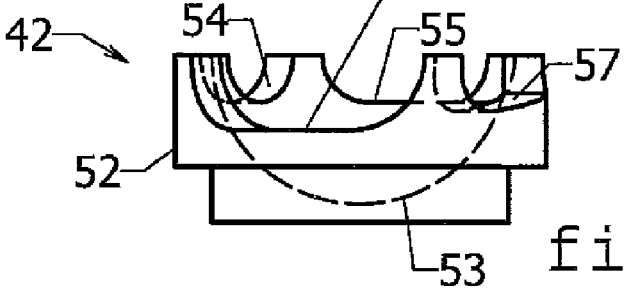
fig 12c
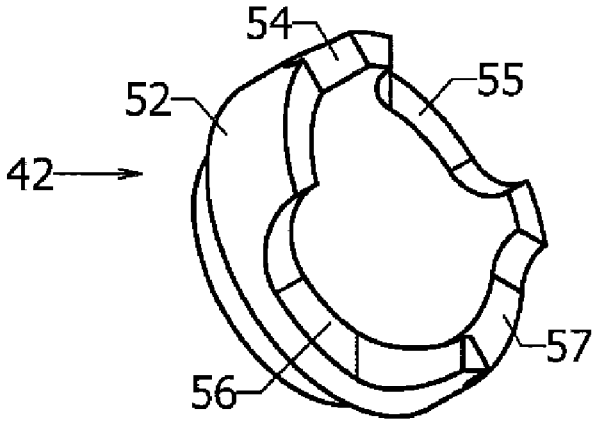
fig 12d

FRAME FOR A CLAP SKATE, AND CLAP SKATE WITH SUCH A FRAME

BACKGROUND OF THE INVENTION

1. Field of the Invention

The invention relates to a frame for a clap skate, which frame comprises:

a lower frame part for carrying a runner or wheels;

an upper frame part with means for coupling to the sole and the heel of a skate shoe;

hinge means which couple the two frame parts hingedly to each other, which hinge means are situated at a distance above the foremost zone of the lower frame part and define a first free degree of freedom of rotation in the main plane, or a plane varying a maximum of about 30° therefrom, of the runner or the wheels; and resetting means for urging the upper frame part relative to the lower frame part to a rest position determined by positioning means, in which rest position the frame parts have the smallest possible mutual distance, for instance in more or less parallel relation to each other.

2. Description of the Related Art

Such a frame is known from NL-C-1005080. According to this publication the clap mechanism is provided under the heel with a centring system with a separate damping element for absorbing the impact of the return stroke. The shoe is further mounted length-adjustably relative to the upper frame part. According to this specification, this gives the skater the possibility of producing extra power at essential moments, this by elongating the ankle. In order to enable a good distribution of this extra power over the runner, the centring system with damping is arranged under the heel.

It is an object of the invention to embody a clap skate of the stated type such that a better and more effective push-off is realized, whereby it is possible to make a quicker start, to travel through a bend at a more acute angle because the shoe is less likely to touch the ice, to push-off better in a bend because the shoe is less likely to touch the ice or the rolling surface, and in particular to push-off better in a bend because the runner or the wheels remain oriented in the direction of travel, and a better push-off is also possible when skating straight ahead.

The prior art clap skate is not faster relative to the conventional fixed skate because the skating stroke becomes longer, but because the skating stroke becomes more economic or more efficient. This is a result of the fact that the forces in the region of the knees and ankles where they occur are more favourable.

SUMMARY OF THE INVENTION

The invention to be described below is based on the insight that the ankle-rotation/leg-rotation is a significant factor during skating which is not taken into account in the prior art clap skate.

The results in major international competitions in which use has been made of clap skates show conclusively that the prior art clap skate has already produced an increase in skating speed relative to the conventional skate. It has been established that skating is about 3% faster, this corresponding to an extra power in the order of magnitude of 10%. It is noted here that a clear distinction is made between the speed increase due to for instance improvements in aerodynamics and the speed increases resulting from the use of clap skates.

The stated objectives are realized according to the invention with a frame for a clap skate of the type stated in the preamble, which has the feature that the hinge means define a second free degree of freedom of rotation within a range of ±30° perpendicularly of the first free degree of freedom, such that the upper frame part can perform an up and downward as well as a lateral pivoting movement relative to the lower frame part.

It is noted here that the third degree of freedom, which could in principle be mechanically realized, must be blocked for the purpose of a desired force transfer since there is otherwise a danger of the runner or the wheels making a lateral tilting movement under the influence of the push-off force.

It is further of very great practical importance that the hinge mechanism does not influence in any way whatsoever the properties of the lower frame part, often referred to as the "tube". This is because it has been found that a difference in rigidity between for instance the steel of the "tube" carrying the runner, and the lower frame part, which is usually manufactured from aluminium, is already a problem for skaters. The lower frame part and the tube are therefore preferably both manufactured from aluminium or both from steel.

Attention is drawn to NL-C-1013271. According to this specification, a rotating device can be arranged between the shoe and the tilting pin and/or between the tilting pin and the rolling or gliding mechanism, with which device the position of the tilting pin can be adjusted relative to the longitudinal direction of the rolling or gliding mechanism. It can be concluded here that this older specification has a hinge mechanism with only one free degree of freedom. Although there is a second degree of freedom, prior to a race or event it is optionally temporarily set fixedly to the value desired by the skater and maintained during the race or the event. This means that the second degree of freedom, which is essentially free according to the invention, is not realized in this prior art so that the advantages sought after according to the invention are therefore not achieved either.

Attention is drawn to the fact that it has been found that starting on clap skates is slower than on conventional skates. The patent specifications NL-C-1017598 and NL-C-1019089 describe structures in which this problem is solved by means of start blocking, wherein the clap skate functions as a conventional skate during starting, and only begins to fulfil its function as clap skate after a number of strokes. The International Skating Union (ISU) considers the electronics which provide for the locking and unlocking in this skate to be an external aid. For this reason skates with such a start blocking are not allowed in competitions in accordance with specified tournament regulations.

Finally, attention is drawn to NL-C-1007303 and NL-C-1007231. Clap skates are also known from these older specifications.

In a determined embodiment the frame has the special feature that the hinge means take a cardan form.

In another embodiment the device has the special feature that the hinge means comprise a ball joint.

According to an important aspect of the invention, the frame has the special feature that the time required by the resetting means to reset the frame parts from the maximum angular displacement in the first degree of freedom and/or in the second degree of freedom to their mutual rest position amounts to a maximum of 400 ms, preferably 300 ms.

In order to be able to realize this technically significant wish under varying conditions, the frame can advantageously have the special feature that the resetting means are adjustable.

This variant can be particularly embodied such that the resetting means comprise spring means, the length and thereby the resilient bias of which can be adjusted continuously or in steps.

The effective resilience can hereby be adjusted, and the time required by the resetting spring means to carry the frame parts from their fully opened to their fully closed position can thereby be influenced.

The resetting means can be embodied in different ways, among others by means of magnetic means. Various desired spring characteristics can hereby be set.

In a preferred embodiment the frame has the special feature that the resetting means comprise spring means. The spring means can here for instance comprise one or more draw springs, compression springs, leaf springs or torsion springs, or combinations thereof.

According to a subsequent aspect of the invention, the frame has the special feature that the positioning means comprise:

a block with a generally V-shaped, narrowing recess present on the one frame part; and a protrusion co-acting therewith present on the other frame part.

Attention is drawn to the fact that according to the invention use can also be made of two such provisions, which are located at mutually differing distances from the hinge. The positioning element located relatively close to the hinge can for instance thus provide for a rough reset positioning, and the positioning element located at a relatively great distance can provide for a fine reset positioning.

According to yet another aspect, the frame according to the invention comprises damping means for damping the shock which occurs during the displacement by the resetting means of the lower frame part to the rest position relative to the upper frame part.

It is noted that damping means are per se known from the prior art, from among others NL-C-1007303 and NL-C-1005080.

According to the invention the frame with said damping means can be embodied such that the damping means comprise a block of rubber or a rubber-like material with a hardness in the order of magnitude of (90±20) Shore (A).

In a preferred embodiment the frame according to the invention comprises first bounding means for bounding the angular displacement in the first degree of freedom to a maximum of 25°, preferably about 20°.

According to another preferred aspect, the frame according to the invention comprises second bounding means for bounding the angular displacement in the second degree of freedom to a maximum of ±50°, preferably about 40°.

The invention also relates to a clap skate, comprising a skate shoe and a frame according to any of the above stated specifications of aspects of the invention coupled to the sole and the heel thereof.

In respect of the practical design of a frame according to the invention it is noted that the following technical requirements are laid down therefor:

The clap skate according to the invention must be able to withstand a force of 1500 N and a peak load of 2000 N. The closing time from maximum opening may be a maximum of 0.3 s. In the first degree of freedom there is a maximum angular displacement of about 20° and in the second degree of freedom of +40°. There may be no bending of the lower frame part relative to the carrier of the runner (the "tube").

Important

It must be possible to couple the frame to any type of commercially available shoe of a specified high-grade quality. All dimensioning, particularly in height direction, must be identical to those in the conventional clap skate. The frame must have a useful life of at least two years or 2,000,000 opening and closing movements in both degrees of freedom. The weight of the frame must be less than 0.45 kg.

It must be as inexpensive as possible and substantially maintenance-free. It must be possible for the skater to carry out possible maintenance him/herself.

BRIEF DESCRIPTION OF THE DRAWINGS

The invention will now be elucidated with reference to the accompanying drawings. In the drawings:

FIG. 12A shows an axial view of a bearing according to FIG. 11;

FIG. 12B shows a partly transparent view from the corresponding side according to FIG. 12A;

FIG. 12C shows a partly transparent view of the corresponding side of FIG. 12A;

FIG. 12D shows a perspective view of the bearing according to FIGS. 12A, 12B and 12C;

DETAILED DESCRIPTION OF THE INVENTION

Figure 1:
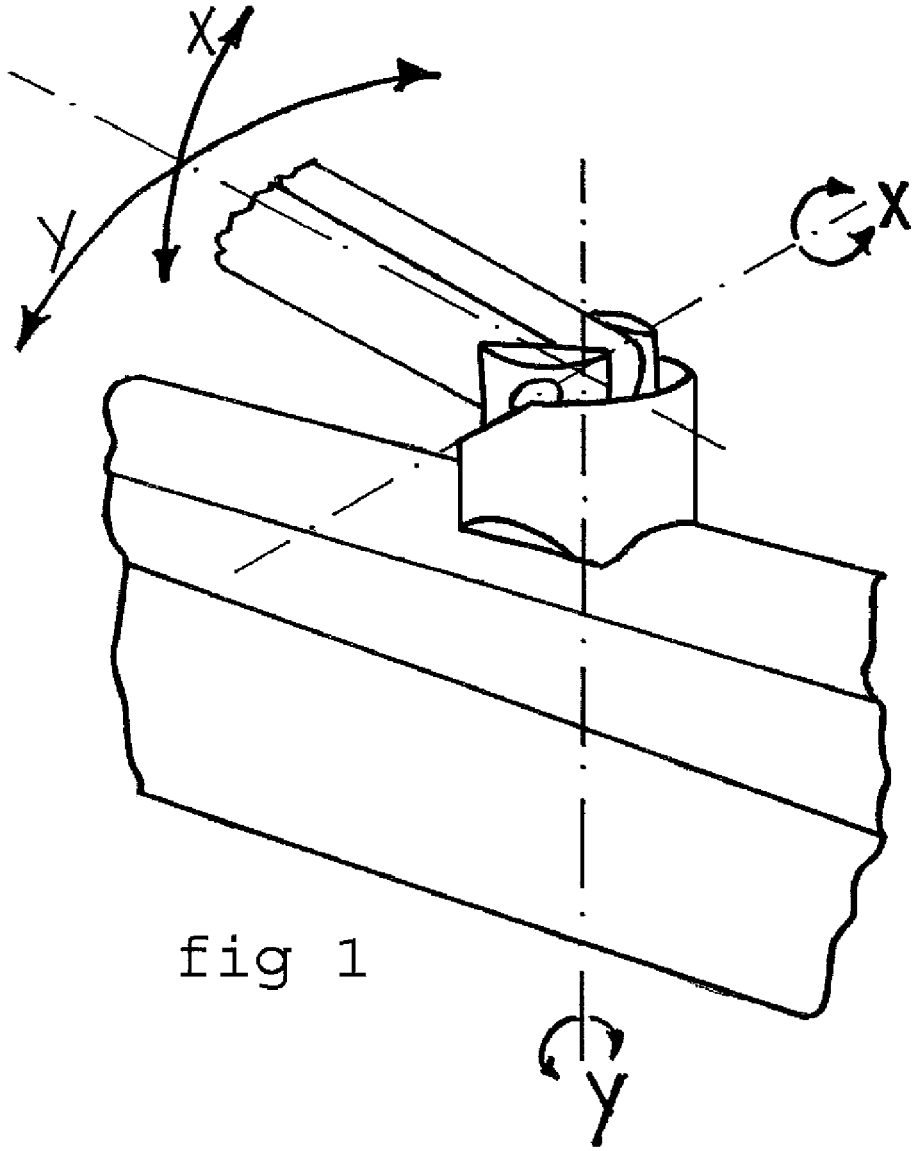
FIG. 1 shows a highly schematic perspective view of a part of a clap skate frame for the purpose of elucidating the two free degrees of freedom according to the invention.
Figure 2:
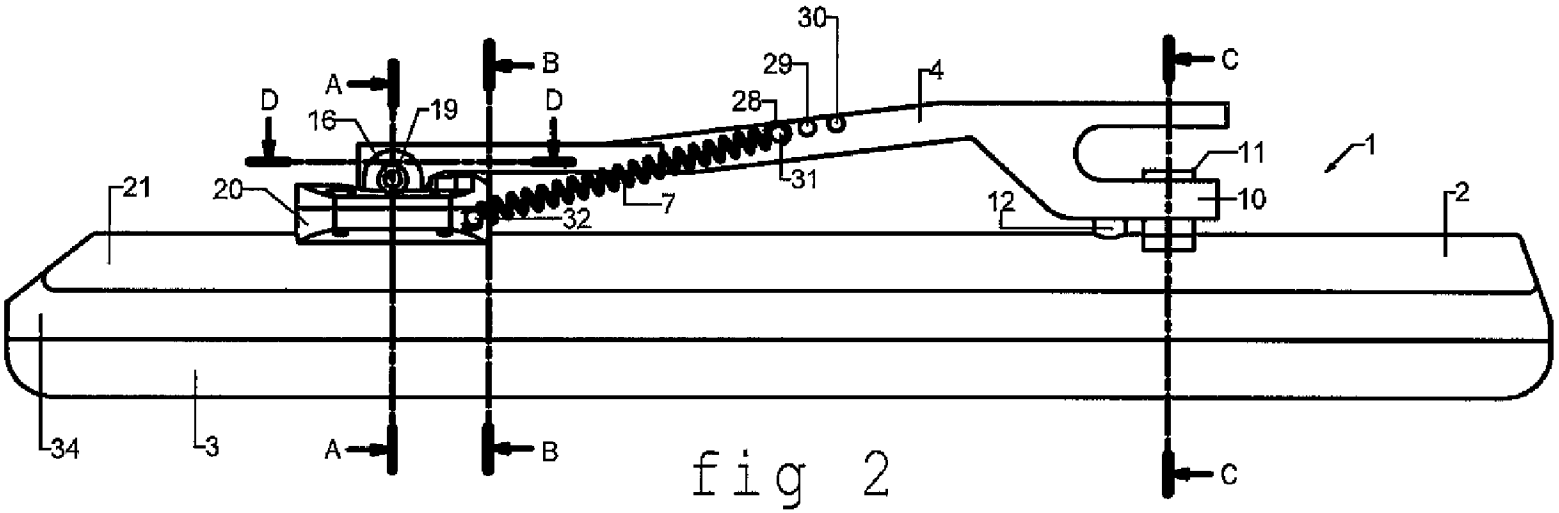
FIG. 2 shows a side view of a practical embodiment.
Figure 3:
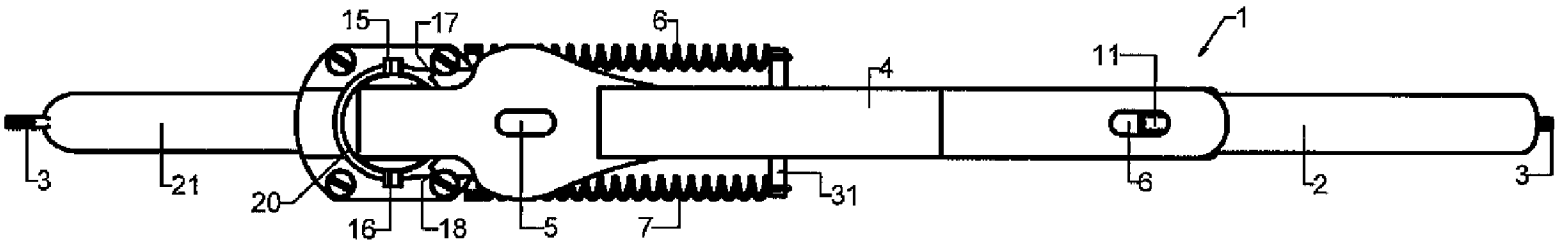
FIG. 3 shows a top view of the embodiment according to FIG. 2.
Figure 4:
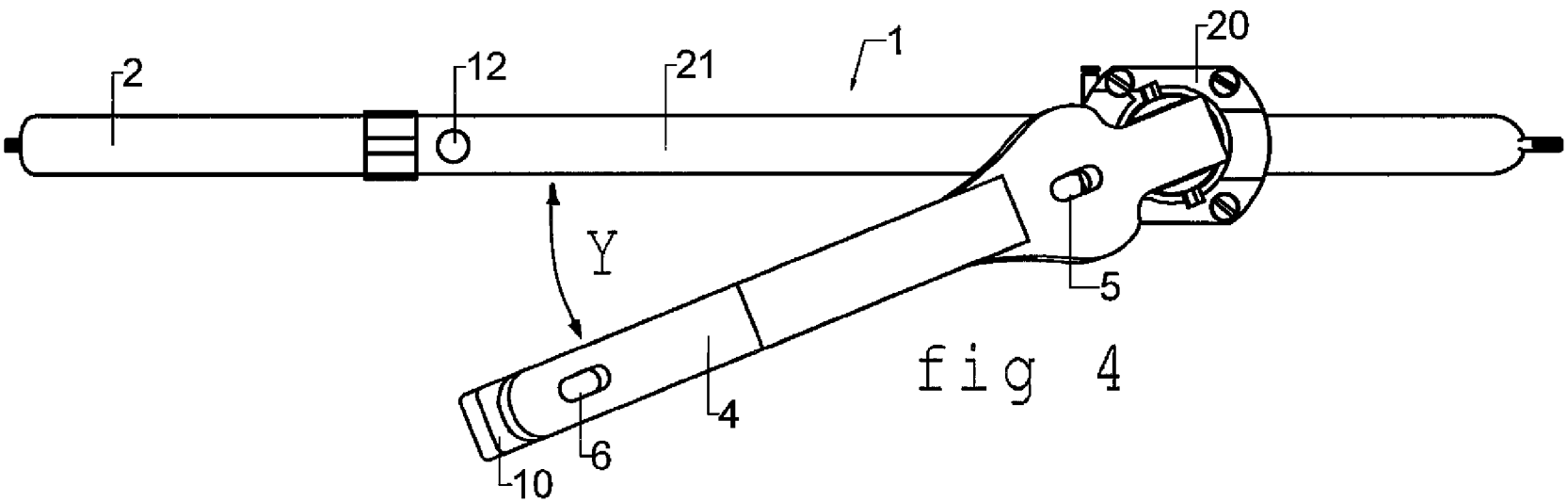
FIG. 4 shows a side view of the frame according to FIGS. 2 and 3 from the other side in a situation where the upper frame part is displaced upward and to the side.
Figure 5:
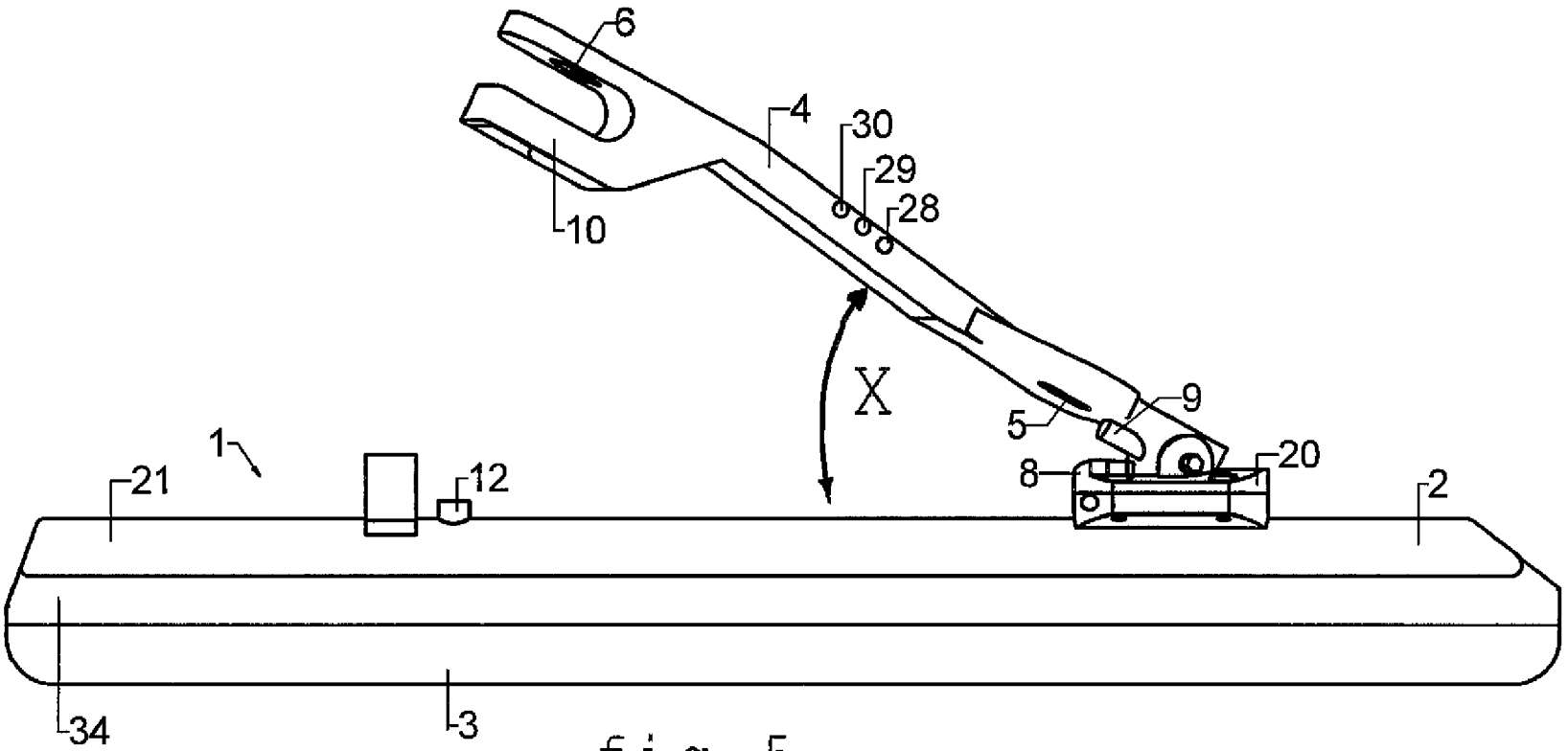
FIG. 5 shows a top view of the frame in the situation according to FIG. 4.
Figure 6:
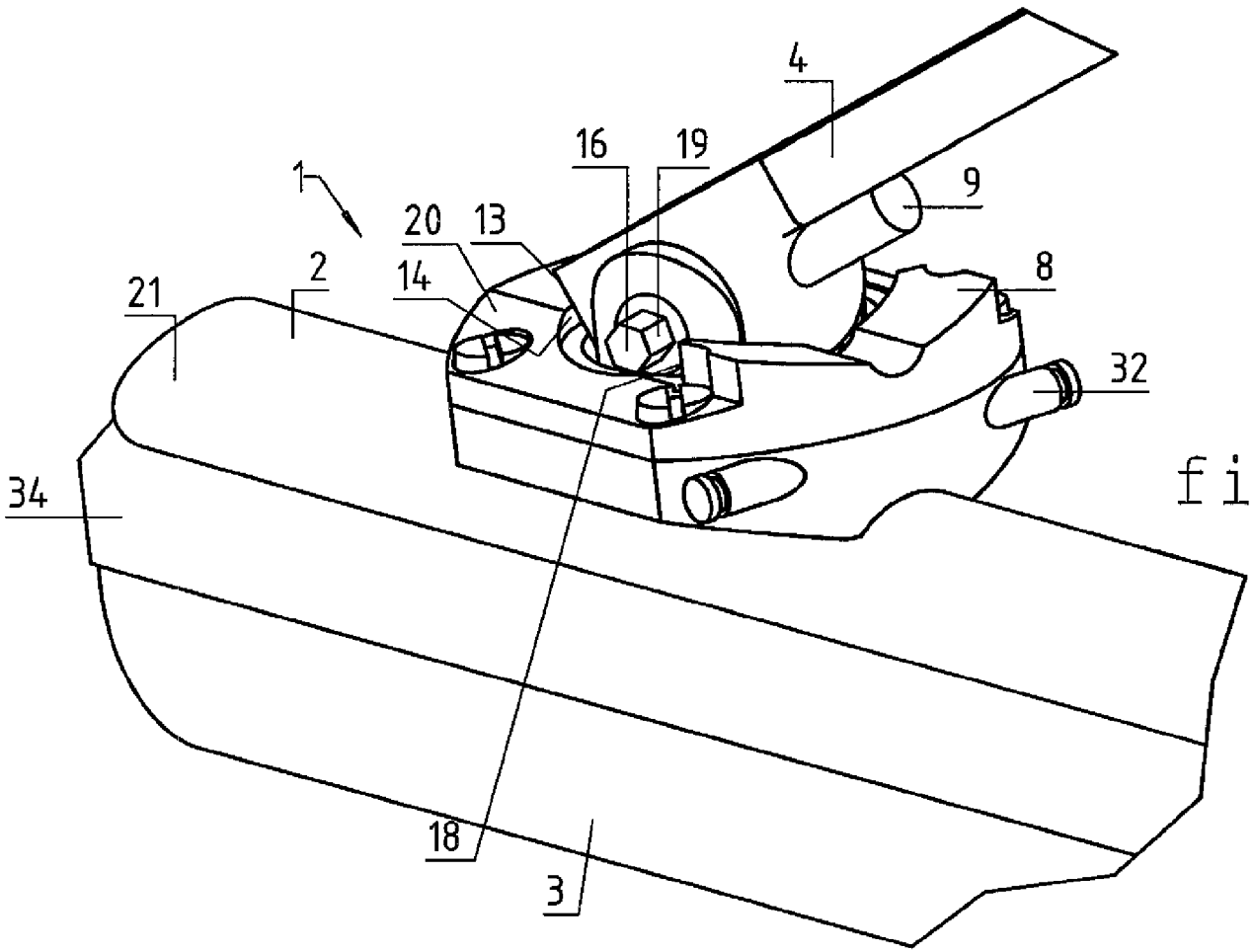
FIG. 6 shows a perspective view on enlarged scale of the hinge mechanism in the position according to FIGS. 4 and 5, as seen from the other side.

FIG. 1 shows a highly schematic perspective view of a part of a clap skate frame 1 according to the invention. This frame 1 comprises a lower frame part 2 which carries a runner 3, and an upper frame part 4 which is carried by means of a hinge mechanism 20 such that upper frame part 4 has two free degrees of freedom of rotation relative to lower frame part 2.

The first free degree of freedom of rotation is designated with X and corresponds to the known degree of freedom of rotation of the prior art clap skate, so an up and downward movement of upper frame part 4 relative to lower frame part 2.

The second free degree of freedom of rotation according to the invention is designated with Y and corresponds to a lateral pivoting movement.

FIGS. 2-10 all relate to a practical exemplary embodiment.

Frame 1 for a clap skate comprises a lower frame part 2 with a so-called "tube" 21 of steel or aluminium, to which a runner 3 of steel or a ceramic material is connected, particularly in the manner shown in FIGS. 7, 8 and 9, by glueing, welding or hard-soldering, an upper frame part 4 with two slotted holes 5, 6 extending in longitudinal direction for coupling to the sole and the heel of a skate shoe, hinge means 20 to be described below in more detail which couple the two frame parts 2, 4 hingedly to each other, which hinge means 20 are situated at a distance above the foremost zone of lower frame part 2 and define a first free degree of freedom X of rotation in the main plane, or a plane varying therefrom by a maximum of about 30°, of runner 3, and resetting springs 6, 7 for urging upper frame part 4 relative to lower frame part 2 to a determined rest position, determined by positioning means 8, 9, 10, 11 to be described hereinbelow, in which rest position frame parts 2, 4 have the smallest possible mutual distance.

Figure 7:
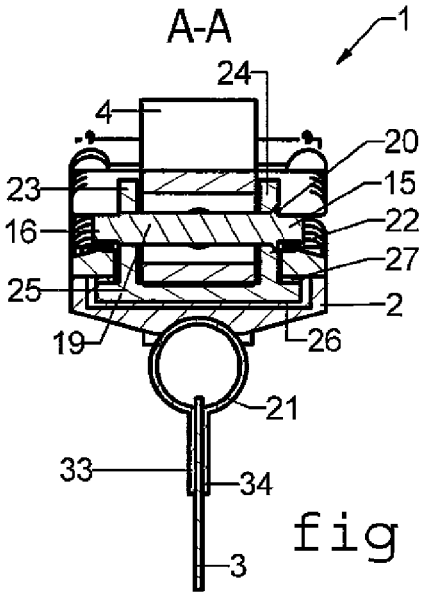
FIG. 7 shows cross-section A-A of FIG. 2.
Figure 8:
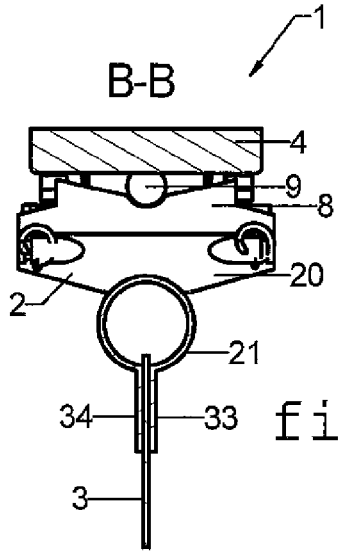
FIG. 8 shows cross-section B-B of FIG. 2.
Figure 9:
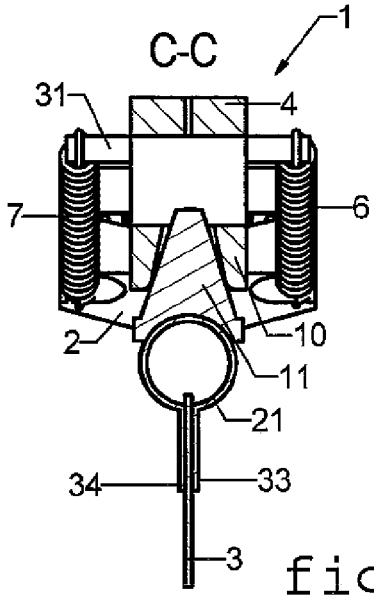
FIG. 9 shows cross-section C-C of FIG. 2.
Figure 10:
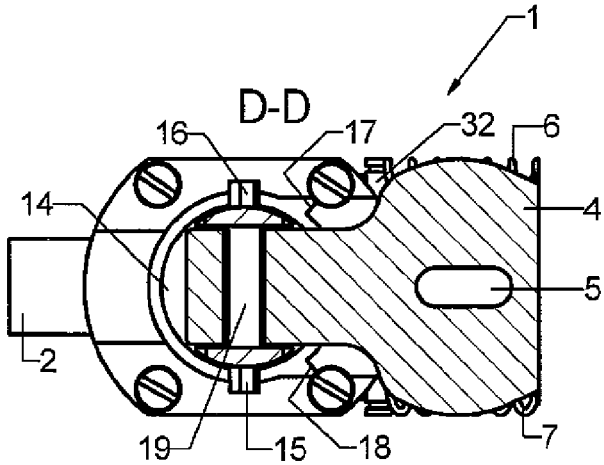
FIG. 10 shows cross-section D-D of FIG. 2.

As shown in FIGS. 7, 8 and 9, runner 3 is received between two plates 33, 34 which are the same as each other and are embodied monolithically with tube 21.

According to the invention hinge means 20 also define a second free degree of freedom Y of rotation within a range of ±30° perpendicularly of the first free degree of freedom X, such that upper frame part 4 can perform an up and downward (first degree of freedom X) as well as a lateral pivoting movement (second degree of freedom Y) relative to lower frame part 2.

The up and downward movement according to the first degree of freedom is provided by a hinge comprising a pivot shaft 19 of refined steel which is connected to upper frame part 4. Pivot shaft 19 is bearing-mounted in a bearing unit 22 (see FIG. 7) by means of an aluminium-bronze bearing.

Bearing unit 22 is freely rotatable according to the second degree of freedom Y in a direction substantially perpendicularly of the first free degree of freedom X. For this purpose bearing unit 22 comprises a round disc 25 which bears two upright plates 23, 24, which in turn carry pivot shaft 19 therebetween. Disc 25 is supported in sliding manner by a slide bearing in the form of a bearing socket 26 of complementary form, for instance of bronze, of PTFE, bronze with a PTFE coating, or with vapour-deposited Permaglide®. The upper peripheral edge of disc 25 is also embedded in a ring of the same material. In this way a sliding rotation bearing is realized for the second degree of freedom Y, while the first degree of freedom X is also defined relative thereto, i.e. by pivot shaft 19. A strong and light material, such as a high-grade type of aluminium, can also be applied.

Resetting springs 6, 7 (see in particular FIGS. 2 and 3) provide for resetting to the drawn mutual rest positions in the two degrees of freedom of the two frame parts 2 and 4. Draw springs 6, 7 engage on one side on lower frame part 2 (see the description below at the end of this paragraph) and on the other side on upper frame part 4. For this purpose use is made on upper frame part 4 of an array of holes, in this exemplary embodiment three, designated 28, 29, 30. A pin 31 can be placed through two corresponding holes present on both sides of the upper frame part for the purpose of coupling the relevant free end of springs 6, 7. A greater reset resilience can be realized by for instance removing the pin from holes 28 (as in FIG. 2) and placing it in hole 29 or 30, whereby the resetting movement will take place in a shorter time. It is an objective according to the invention to make this resetting time as short as possible. A time shorter than 300 ms is not considered useful. The aim is therefore this value of about 300 ms. In order to absorb the impact upon reaching the rest position, use is made of a damping block 12 of rubber or a rubber-like material with a hardness of about 80-90 Sh(A) which is arranged on the rear zone of lower frame part 2. The other ends of resetting springs 6, 7 engage on the ends of a pin 32, which is connected to hinge mechanism 20 and thus forms part of lower frame part 2.

It is important to reach and accurately define the rest position for the two degrees of freedom X and Y in simple manner. Use is made for this purpose of two resetting mechanisms, one for a rough approximation and one for a fine approximation. Reference is made to FIG. 8 for the rough approximation. This figure shows a first block 8 with a generally V-shaped, downward tapering form, into which fits a steel centring pin 9. Block 8 forms part of the lower frame part and protrusion 9 is embodied as a pin which forms part of the upper frame part (see in particular FIG. 6). Using this mechanism, which is situated a relatively short distance from pivot shaft 19, a resetting in a first-order approximation is realized.

A finer, more precise adjustment is realized with a second reset positioning mechanism, which is situated a relatively great distance from pivot shaft 19 and comprises a second block 10 with a recess on upper frame part 4 and a second centring pin 11 on lower frame part 2. As in FIG. 8, FIG. 9 shows this structure in the rest position.

For the purpose of bounding the angular displacement in the first degree of freedom X use is made of first bounding means, comprising front surface 13 of upper frame part 4, which can co-act with stop edge 14 of hinge mechanism 20.

For the purpose of bounding the angular displacement in the second degree of freedom Y to a maximum of ±40°, for the one direction the first end zone 15 of pivot shaft 19 can co-act with a first stop shoulder of hinge mechanism 20. For the other direction the second end zone 16 of pivot shaft 19 co-acts with a second stop shoulder 18. Particular reference is made to FIG. 10 in this respect.

FIGS. 11-15 show a variant. In this embodiment the clap skate frame comprises a ball joint to be described hereinbelow. Anticipating the following discussion of said figures, it is already noted here that they are shown partly schematically and that, for the sake of the clarity of the essential relation between the components, resetting springs 6 and 7 with their associated fastening points, screw threads and lower frame part 2 with runner 3, damping block 12 and the like are for instance not drawn. Such components can however form part of the variant with the ball joint to be described hereinbelow.

Figure 11:
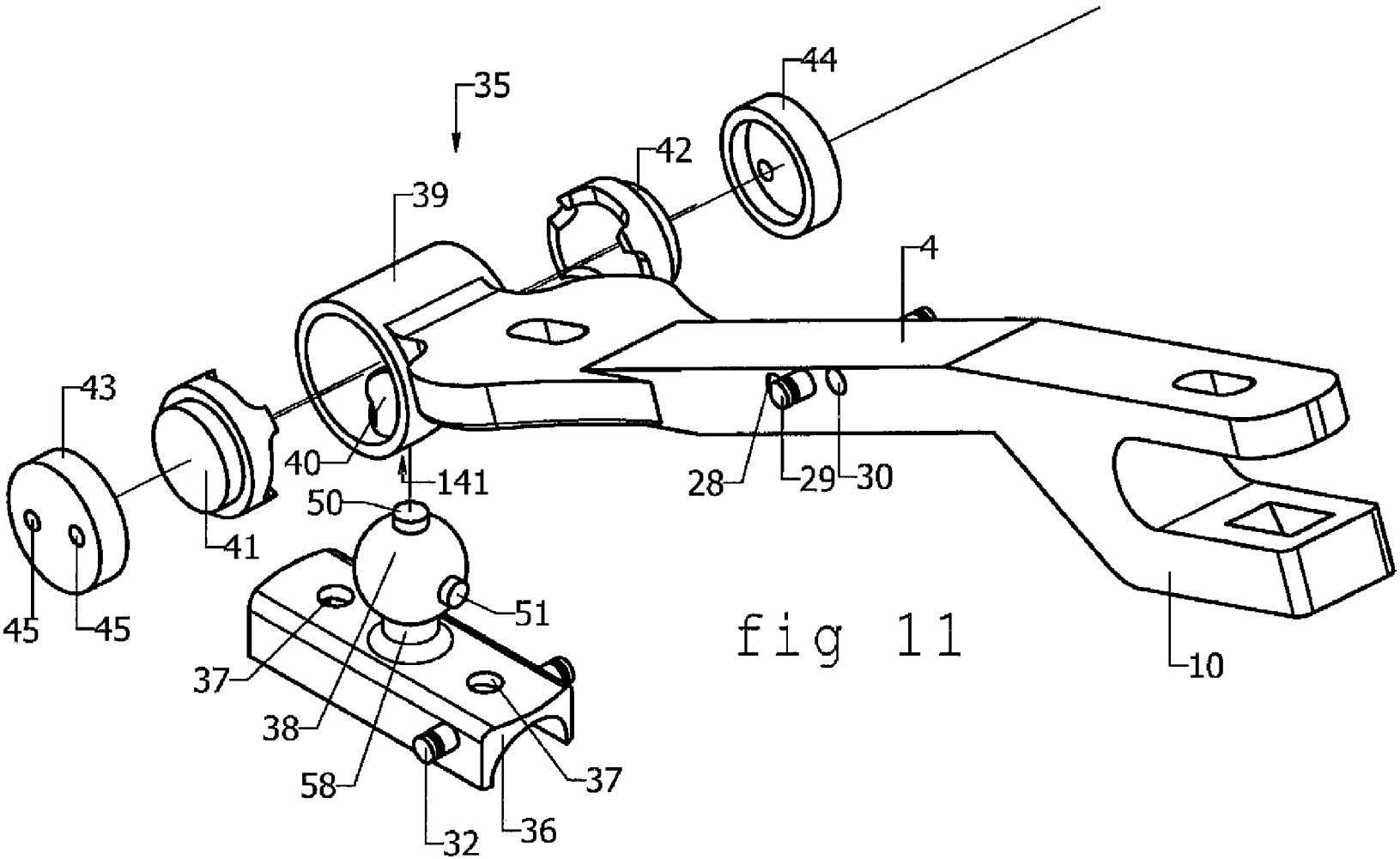
FIG. 11 shows an exploded, highly schematic view of a number of essential components of an important variant.

FIG. 11 shows an exploded view of a unit 35 which forms the heart of the clap skate mechanism with the degrees of freedom according to the present invention. A mounting block 36 can be inseparably coupled to tube 21 via holes 37 by means of pop rivets, which tube has been shown in a number of the foregoing figures. Mounting block 36 supports a spherical ball 38, which forms part of the ball joint according to this embodiment. A sleeve 39, to which upper frame part 4 is rigidly connected, comprises a through-hole 40 for passage of ball 38 as according to arrow 141. After ball 38 has been inserted in this manner into sleeve 39, two bearing sockets 41, 42 in sleeve 39 are moved toward ball 38. These bearing sockets 41, 42 are then enclosed in sleeve 39 by arranging and thus fixing associated covers 43, 44 by means of screwing, wherein ball 38 is enclosed in sockets 41, 42 with very little clearance by corresponding spherical inner surfaces. For the sake of simplicity in the drawing the screw threads in question are not drawn.

For the purpose of screwing on covers 43, 44 these covers are provided in per se known manner with gripping recesses 45, for instance blind holes, into which two pins forming part of a screwdriver can be inserted in order to tighten covers 43, 44 in screwing manner.

As shown clearly in FIG. 11, ball 38 is provided on its top side with a protrusion 50 serving as first guide and stop, and on its rear side with a similar second guide and stop protrusion 51. Once covers 43, 44 have been screwed on, these protrusions co-act with parts of bearing sockets 41, 42, to be described hereinbelow, in which the ball 38 is accommodated in fully closing manner.

FIGS. 12A, 12B, 12C and 12D show bearing socket 41. This comprises a peripheral edge 52 which bounds a semi-spherical inner surface 53 and has the following edge recesses:

- a first edge recess 54 which serves to lock bearing sockets 41, 42 relative to each other and relative to sleeve 39, and thereby upper frame part 4.
- a second recess 55 which ensures that the skate cannot tilt since the edges of the recess slide along the first protrusion 50.
- a third recess 56, which serves to provide the ankle rotation, also ensures that the upper frame part comes to lie in its median rest position again when pivoting-back takes place.
- a fourth recess 57 which ensures that sleeve 39 with upper frame part 4 cannot tilt since the edges of fourth recess 57 slide along stem 58 of ball 38.

The angle 59 at which the bottom surface of recess 57 is directed determines the angular deflection of the ankle rotation when the clap mechanism opens and further ensures that tube 21 is returned to its correct, centred rest position.

Figure 13:
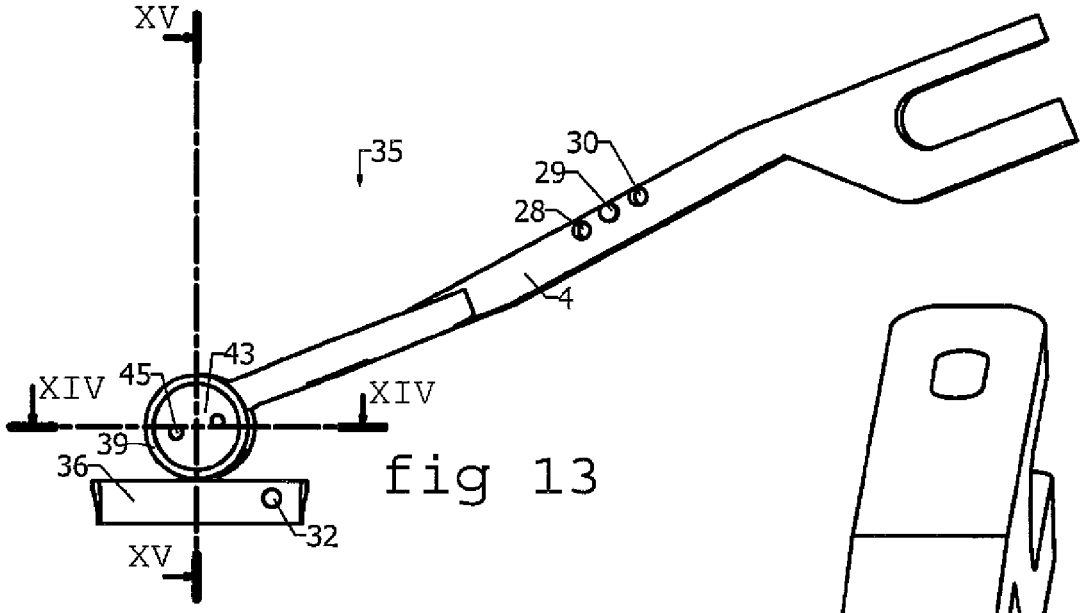
FIG. 13 shows a side view of the assembled unit according to FIG. 11.

FIG. 13 shows a side view of the assembled unit 35 drawn in exploded view in FIG. 11.

Figure 14:
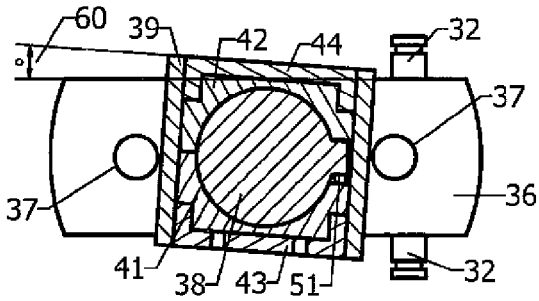
FIG. 14 shows cross-section XIV-XIV of FIG. 13.
Figure 15:
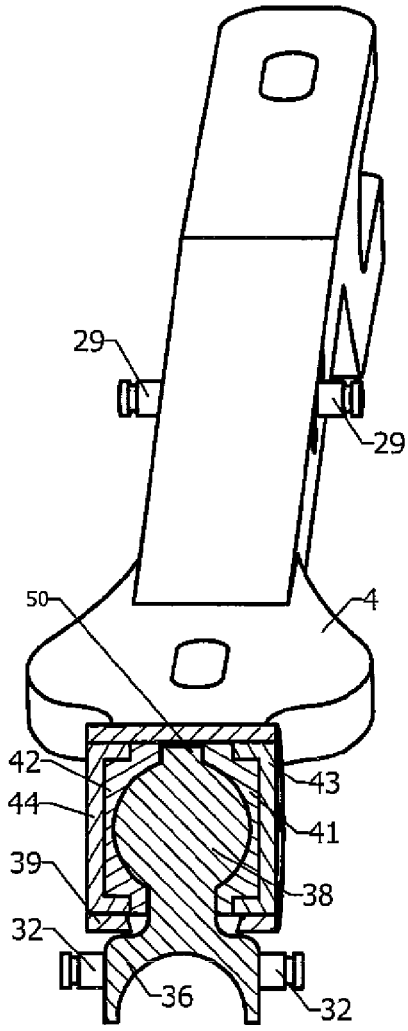
FIG. 15 shows the cross-section XV-XV of FIG. 13.

FIGS. 14 and 15 show the corresponding cross-sections XIV-XIV and XV-XV.

Ball 38 is preferably manufactured from a strong, wear-resistant and light material, for instance a high-grade type of aluminium. Bearing sockets 41, 42 can be manufactured from the same material. Bronze is also suitable, although a material with a lower density is recommended. This is because a weight reduction of a number of grams can hereby be realized, this being considered substantial for a skate.

The relevant co-acting surfaces of ball 38 and/or of bearing sockets 41, 42 can be provided with a layer of PTFE, for instance by vapour-deposition.

It is noted that all degrees of freedom of movement according to the invention are defined by ball joint 30, 41, 42.

In FIG. 14 the reference numeral 60 designates the angle of ankle rotation.

The figures and the description thereof relate only to exemplary embodiments. It will be apparent that diverse changes and modifications fall within the scope of the invention.

The invention claimed is:

1. A frame for a clap skate, which frame comprises:

a lower frame part for carrying a runner or wheels;

an upper frame part with means for coupling to a sole and a heel of a skate shoe;

a hinge which couples the lower frame part and the upper frame part hingedly to each other, which hinge is situated at a distance above a foremost zone of the lower frame part and defines a first free degree of freedom of rotation in a main plane, or a plane varying a maximum of about 30° therefrom, of the runner or the wheels; and a resetting means for urging the upper frame part relative to the lower frame part to a rest position determined by a positioning means, in which rest position the lower frame part and the upper frame part have a smallest possible mutual distance;

wherein the hinge comprises a ball joint, and wherein the hinge defines a second free degree of freedom of rotation within a range of ±30° perpendicularly of the first free degree of freedom, such that the upper frame part can perform an upward and downward as well as a lateral pivoting movement relative to the lower frame part.

2. The frame as claimed in claim 1, wherein the resetting means are adjustable.

3. The frame as claimed in claim 2, wherein the resetting means comprises at least one spring, a length and thereby the resilient bias of which can be adjusted continuously or in steps.

4. The frame as claimed in claim 1, wherein a time required by the resetting means to reset the lower frame part and the upper frame part from a maximum angular displacement in the first free degree of freedom or in the second free degree of freedom to mutual rest position amounts to a maximum of 400 ms.

5. The frame as claimed in claim 1, wherein a time required by the resetting means to reset the lower frame part and the upper frame part from a maximum angular displacement in the first free degree of freedom or in the second free degree of freedom to mutual rest position amounts to 300 ms.

6. The frame as claimed in claim 1, wherein the positioning means comprises:

a block with a generally V-shaped, narrowing recess present on the one of the lower frame part or the upper frame part; and a protrusion co-acting therewith present on the other of the lower frame part or the upper frame part.

7. The frame as claimed in claim 1, comprising a damping means for damping a shock which occurs during a displacement by the resetting means of the lower frame part to the rest position relative to the upper frame part.

8. The frame as claimed in claim 7, wherein the damping means comprises a block of rubber or a rubber-like material with a hardness in the order of magnitude of (90±20) Shore A.

9. The frame as claimed in claim 1, comprising a first bounding means for bounding an angular displacement in the first free degree of freedom to a maximum of 25°.

10. The frame as claimed in claim 9, comprising a first bounding means for bounding an angular displacement in the first free degree of freedom to about 20°.

11. The frame as claimed in claim 1, comprising a second bounding means for bounding an angular displacement in the second free degree of freedom to a maximum of 50°.

12. The frame as claimed in claim 11, comprising a second bounding means for bounding an angular displacement in the second free degree of freedom to about 40°.

13. A clap skate, comprising a skate shoe and a frame as claimed in claim 1 coupled to the sole and the heel thereof.

14. A frame for a clap skate, which frame comprises:

a lower frame part for carrying a runner or wheels;

an upper frame part with means for coupling to a sole and a heel of a skate shoe;

a hinge which couples the lower frame part and the upper frame part hingedly to each other, which hinge is situated at a distance above a foremost zone of the lower frame part and defines a first free degree of freedom of rotation in a main plane, or a plane varying a maximum of about 30° therefrom, of the runner or the wheels; and a resetting means for urging the upper frame part relative to the lower frame part to a rest position determined by a positioning means, in which rest position the lower frame part and the upper frame part have a smallest possible mutual distance;

wherein the hinge takes a cardan form, and wherein the hinge defines a second free degree of freedom of rotation within a range of +30° perpendicularly of the first free degree of freedom, such that the upper frame part can perform an upward and downward as well as a lateral pivoting movement relative to the lower frame part.

15. The frame as claimed in claim 14, wherein the resetting means are adjustable.

16. The frame as claimed in claim 15, wherein the resetting means comprises at least one spring, a length and thereby the resilient bias of which can be adjusted continuously or in steps.

17. The frame as claimed in claim 14, wherein a time required by the resetting means to reset the lower frame part and the upper frame part from a maximum angular displacement in the first free degree of freedom or in the second free degree of freedom to a mutual rest position amounts to a maximum of 400 ms.

18. The frame as claimed in claim 14, wherein a time required by the resetting means to reset the lower frame part and the upper frame part from a maximum angular displacement in the first free degree of freedom or in the second free degree of freedom to mutual rest position amounts to 300 ms.

19. The frame as claimed in claim 14, wherein the positioning means comprises:

a block with a generally V-shaped, narrowing recess present on the one of the lower frame part or the upper frame part; and a protrusion co-acting therewith present on the other of the lower frame part or the upper frame part.

20. The frame as claimed in claim 14, comprising a damping means for damping a shock which occurs during a displacement by the resetting means of the lower frame part to the rest position relative to the upper frame part.

21. The frame as claimed in claim 20, wherein the damping means comprises a block of rubber or a rubber-like material with a hardness in the order of magnitude of (90+20) Shore A.

22. The frame as claimed in claim 14, comprising a first bounding means for bounding an angular displacement in the first free degree of freedom to a maximum of 25°.

23. The frame as claimed in claim 22, comprising a first bounding means for bounding an angular displacement in the first free degree of freedom to about 20°.

24. The frame as claimed in claim 14, comprising a second bounding means for bounding an angular displacement in the second free degree of freedom to a maximum of 50°.

25. The frame as claimed in claim 24, comprising a second bounding means for bounding an angular displacement in the second free degree of freedom to about 40°.

26. A clap skate, comprising a skate shoe and a frame as claimed in claim 14 coupled to the sole and the heel thereof.

* * * * *